US006899070B2

(12) United States Patent
Neal

(10) Patent No.: US 6,899,070 B2
(45) Date of Patent: May 31, 2005

(54) ENGINE WITH DUAL OILING AND HYDRAULIC VALVES

(75) Inventor: Timothy L. Neal, Ortonville, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/619,363

(22) Filed: Jul. 14, 2003

(65) Prior Publication Data

US 2005/0011478 A1 Jan. 20, 2005

(51) Int. Cl.[7] ..... F01L 9/02

(52) U.S. Cl. ..... 123/90.12; 123/90.15; 123/196 A; 184/6.5; 137/544; 60/453

(58) Field of Search ..... 123/196 A, 90.12, 123/90.15, 90.17, 90.33, 90.34, 90.37; 184/6.5, 6.9; 137/544, 545, 549, 550; 60/453, 454

(56) References Cited

U.S. PATENT DOCUMENTS 2,337,449 A * 12/1943 Cattaneo et al. ..... 123/196 A
5,085,181 A * 2/1992 Feuling ..... 123/90.12
5,511,523 A * 4/1996 Masuda ..... 123/196 R
5,617,822 A * 4/1997 Masuda ..... 123/196 R
5,738,062 A * 4/1998 Everts ..... 123/195 R
2003/0168031 A1 * 9/2003 Fenelon et al. ..... 123/90.13

* cited by examiner

*Primary Examiner*—Thomas Denion
*Assistant Examiner*—Jaime Corrigan
(74) *Attorney, Agent, or Firm*—Karl F. Barr, Jr.

(57) ABSTRACT

An internal combustion engine has a plurality of cylinders containing pistons connected with a crankshaft for transmitting power. The cylinders have closed ends, intake and exhaust ports communicating with the cylinders through the closed ends, valves operable to open and close the ports to air and exhaust flow to and from the cylinders, and a lower end pressure oil lubrication system operative to lubricate at least the cylinders, pistons and crankshaft of the engine. The engine includes hydraulic actuators operable to actuate the valves and forming part of a separate upper end hydraulic oil actuation system operative to selectively supply high pressure hydraulic oil to the hydraulic actuators to actuate the valves in a predetermined manner. Optionally, the hydraulic system may have an oil reservoir within the engine block, such as in the valley between the cylinder banks of a V type engine.

8 Claims, 2 Drawing Sheets

ENGINE WITH DUAL OILING AND HYDRAULIC VALVES

TECHNICAL FIELD

This invention relates to internal combustion engines and, more particularly, to engines having hydraulic valve actuation and dual oiling systems.

BACKGROUND OF THE INVENTION

It is known in the art relating to internal combustion (IC) engines to provide a single pressure oil system for lubricating all or most of the moving components that require lubrication. In the cylinder heads, these may include rocker arms, camshafts, valve lifters valves and other mechanisms, such as pushrods in some engines. In the cylinder block and crankcase are found cylinders, pistons, connecting rods and a crankshaft, as well as oil and water pumps and, sometimes, balance shafts. Camshaft chain or gear drives may also require lubrication.

A single lubrication or oiling system is generally used to lubricate all these components as well as to actuate hydraulic valve lifters and to cool the pistons. A low pressure oil pump is generally used to draw oil from a single sump in the oil pan, or lower part of the crankcase, and supply the oil under pressure to all the components needing pressure lubrication.

Development of an engine in which the valves are hydraulically actuated raised the possibility that an improved oiling system might be developed which would better serve the purposes of lubrication and actuation of hydraulic components of the engine. Accordingly, an improved engine oiling system for these purposes was desired.

SUMMARY OF THE INVENTION

The present invention provides a dual oiling system for an engine having hydraulic valve actuation. The system includes a lower end pressure oil lubrication system and a separate upper end pressure oil hydraulic system.

The lower end system is provided to lubricate and cool the combustion exposed cylinders and pistons as well as the crankshaft journals and other devices, not shown, such as a water pump, balance shafts, drive chains, and others, if used, which require lubrication. The lower end system may be a conventional low pressure oiling system with the limited requirement of lubricating and cooling only the operating components carried in or by the engine cylinder block.

The upper end system comprises a valve actuating system provided to operate hydraulic valve actuators for opening and/or closing the engine valves, including intake valves which control the admission of air or combustible mixtures into the cylinders, and exhaust valves which control the exhaust of combustion products from the cylinders. The actuators may be of any suitable type which are hydraulically actuated to at least open the valves. The actuators may be electrically or otherwise controlled so as to eliminate a need for camshafts, rocker arms, valve lifters, pushrods and other conventional valve gear from the engine cylinder heads, which close the upper ends of the cylinders and in which the valves may be conventionally carried. Thus, the valves may be closed by conventional valve springs and opened by oil actuated plungers reciprocable in hydraulic sleeves, or more complex hydraulic mechanisms may be employed.

The (upper end) high pressure hydraulic system preferably utilizes a high pressure hydraulic pump drawing from a sump separate from that of the (lower end) low pressure lubricating system. Thus the systems are entirely separate and oils in the two systems may be diversely specified to be appropriate for the functions each oil performs and the conditions in which it operates. Accordingly, conventional motor oils formulated for pressure lubrication and cooling functions along with exposure to combustion products and unburned fuel may be used in the lower end system. The upper end system may use a hydraulic oil suitable to actuate and lubricate the hydraulic plungers of the actuators but without the need for additives to control soot or fuel contamination.

Preferably, the upper end hydraulic system may be contained within the engine covers with the hydraulic valve actuators located beneath the valve covers above the cylinder heads, or within the cylinder heads, if desired. The oil sump for the upper end system may be located in the valley between the cylinder banks of a V type engine with separation of the valley from the engine crankcase where, or below which, the lower end oil sump is conventionally located. For in-line engines, or for any engine type, if desired, a separate sump for the upper end system could be provided adjacent the cylinder bank, or at any other convenient location.

Thus, the design of the dual system is preferably such that the upper end system circulates hydraulic oil from an upper oil sump through a pickup tube, high pressure oil pump, oil filter and oil cooler, if needed, to the valve actuators as required for opening their respective valves. Oil discharged from the actuators during valve closing or by leakage is preferably returned by gravity from the cylinder heads back to the oil sump.

The lower end system conventionally circulates lubricating oil from the crankcase or oil pan, through a pickup tube, low pressure oil pump, oil filter and oil cooler to main oil galleries in the cylinder block. These feed oil as needed to the crankshaft bearings and piston oil squirters, or other means of piston lubrication and cooling. Return oil drains by gravity back through the crankcase to the engine oil pan.

The engine valve stems may be supported by prelubricated valve guides or other means not requiring outside lubrication. Alternatively, the valve stems may be lubricated by the hydraulic oil returning through the cylinder heads. It would also be possible, if necessary, to lubricate the valve stems with oil from the low pressure system.

These and other features and advantages of the invention will be more fully understood from the following description of certain specific embodiments of the invention taken together with the accompanying drawings.

DESCRIPTION OF THE PREFERRED EMBODIMENT

Figure 1:
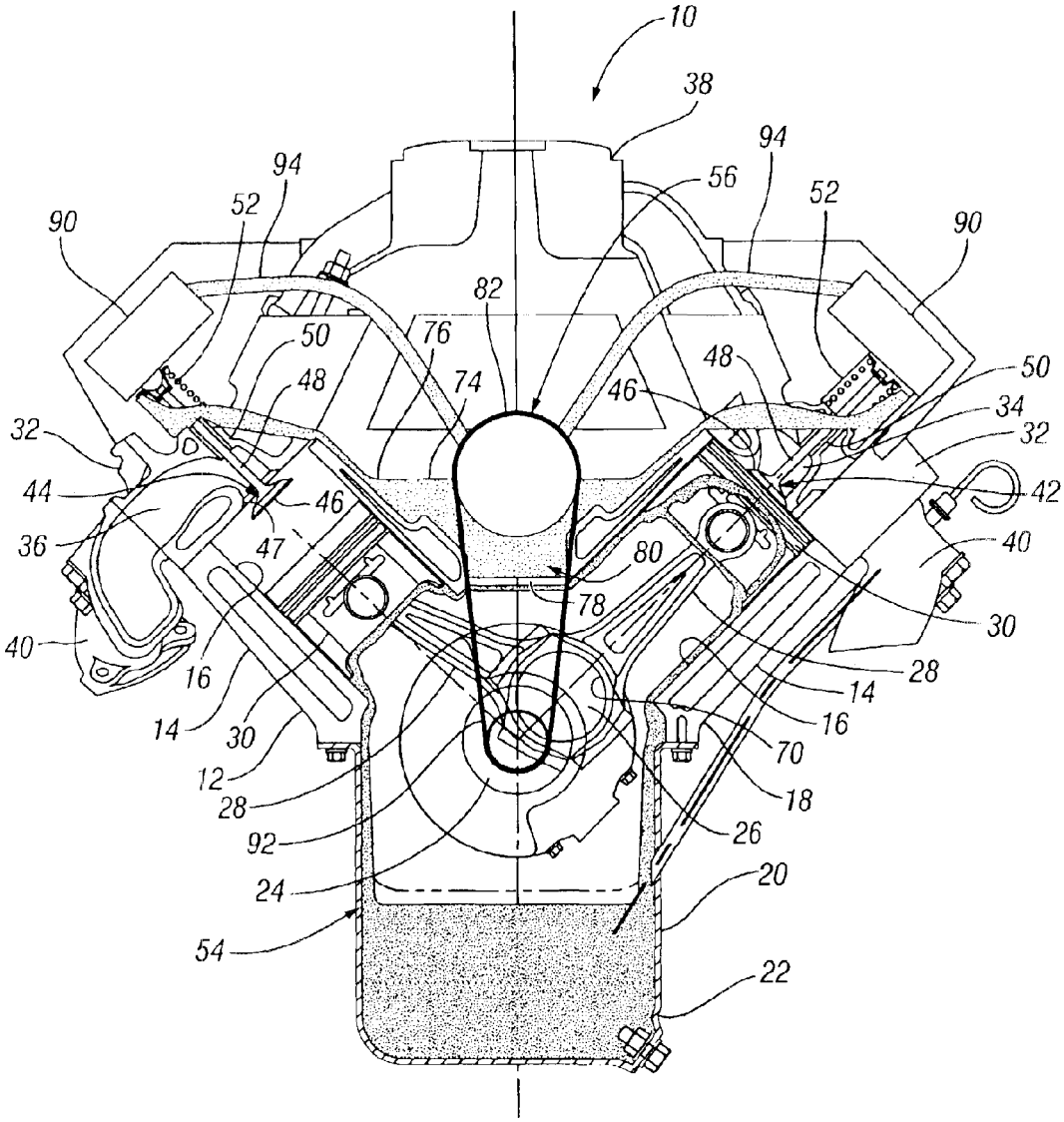
FIG. 1 is a cross-sectional view of an engine having hydraulic valves and a dual oiling system according to the invention.

Referring first to FIG. 1 of the drawings in detail, numeral 10 generally indicates a V type internal combustion engine intended primarily for automotive applications. Engine 10 includes a cylinder block 12 having two V angled banks 14 of cylinders 16 open at the bottom to a crankcase 18 closed by an oil pan 20 forming a lower oil sump 22. The crankcase 18 conventionally supports a crankshaft 24 having main journals, not shown, and crankpins 26 connected by connecting rods 28 to pistons 30 reciprocably mounted in the cylinders 16.

The upper ends of the cylinders are closed by cylinder heads 32 containing intake ports 34 and exhaust ports 36 opening through the closed ends of the cylinders 16. The intake ports 34 connect with an intake manifold 38 mounted between the cylinder heads 32 and adapted to supply intake air/fuel mixture to the intake ports 34. The exhaust ports 36 connect with exhaust manifolds 40 mounted on the cylinder heads 32 and adapted to carry away exhaust products exhausted to the exhaust ports 36 from the cylinders 16.

The cylinder heads carry intake valves 42 and exhaust valves 44. The intake valves 42 control the admission of air/fuel mixture from the intake ports 34 to the cylinders 16. The exhaust valves 44 control the discharge of exhaust products from the cylinders 16 to the exhaust ports 36. Both the intake and exhaust valves have heads 46 which engage valve seats 47 in the heads to close their respective ports. The valve heads 46 are supported by valve stems 48, reciprocable in valve guides 50 in the cylinder heads 32. Valve springs 52 conventionally urge the valves 42, 44 toward closed positions seated on their respective valve seats 47.

Figure 2:
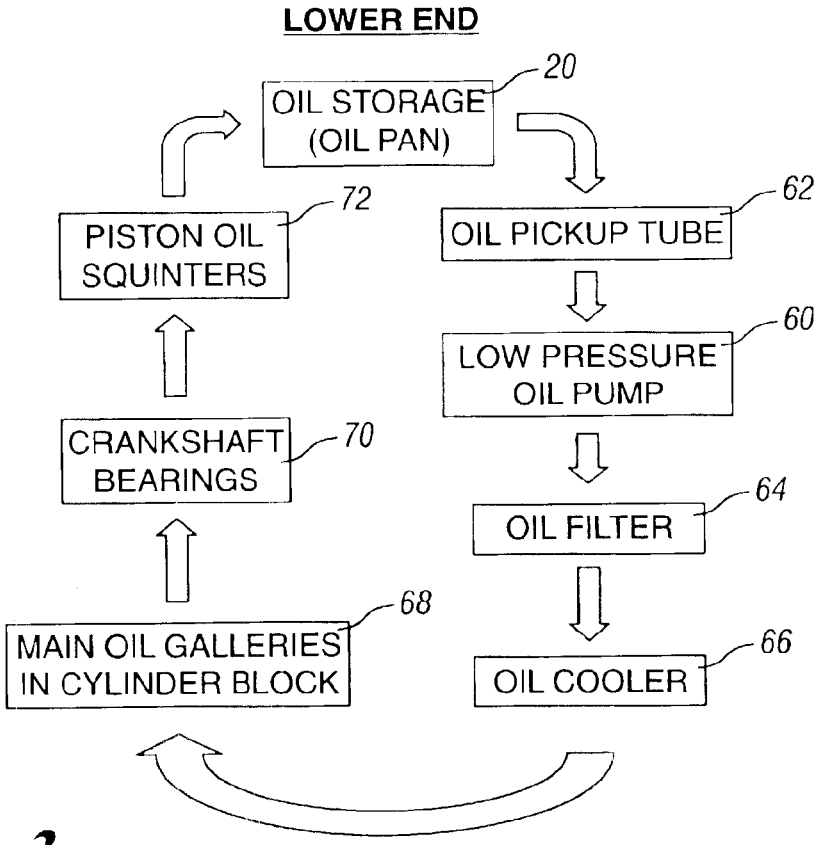
FIG. 2 is a flow chart illustrating operation of the lower end lubrication system of FIG. 1.

In accordance with the invention, the engine includes dual oiling systems including a lower end pressure oil lubrication system 54 and an upper end pressure oil hydraulic system 56. FIG. 2 discloses operationally related components of the lower end system, some of which are also shown in FIG. 1. Referring to FIGS. 2 and 1, the engine oil pan 20 provides a lower oil sump 22 for the storage of lubricating oil in the system 54. In operation, a low pressure oil pump 60, mounted in the oil pan 20 or on the crankcase 18, draws oil from the sump 22 through a pickup tube 62. The pump delivers the pressurized oil through an oil filter 64 and oil cooler 66 to main oil galleries 68 located in the cylinder block.

The oil galleries feed oil to crankshaft bearings 70, including both main and crankpin bearings, and to piston oil squirters 72 positioned to deliver oil into the pistons to lubricate wrist pin bearings as well as the cylinder and piston walls. The oil is also used to cool the underside of the piston crown and the ring belt, which are conventional parts of the pistons. Oil is returned by gravity from the crankshaft bearings, pistons and cylinders to the oil pan, where it is again available for circulation through the lubrication system 54.

The upper end hydraulic system 56 includes a separate oil reservoir 74 located in a valley 76 formed by inside walls of the cylinder banks 14. A transverse wall 78 at the bottom of the valley separates the valley 76 from interior of the crankcase 18 below.

Figure 3:
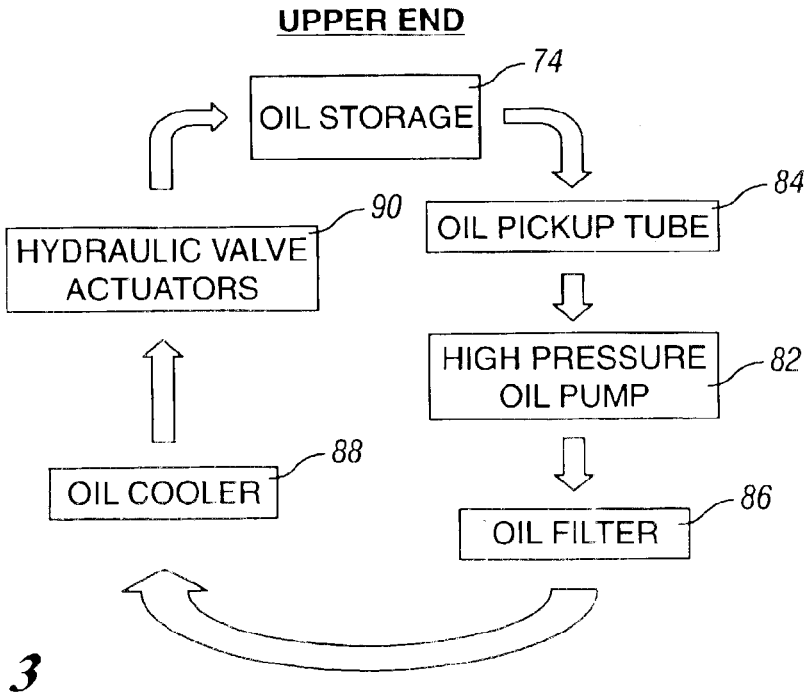
FIG. 3 is a flow chart illustrating operation of the upper end valve actuating system of FIG. 1.

FIG. 3 discloses operationally related components of the upper end pressure oil hydraulic system, some of which are also shown in FIG. 1. Referring to FIGS. 3 and 1, the valley oil reservoir 74 provides an oil sump 80 for the storage of hydraulic oil in the system 54. In operation, a high pressure oil pump 82, mounted in the valley 76, draws oil from the sump 80 through a pickup tube 84. The pump delivers the pressurized oil through an oil filter 86 and oil cooler 88, if needed, to hydraulic valve actuators indicated by boxes 90 in FIGS. 1 and 3. Actuators 90 may be located above or in the cylinder heads and directly engage the intake and exhaust valves 42, 44.

The actuators 90 may be of any suitable hydraulic type adequate to perform the function of quickly opening the valves 42, 44 against the valve springs 52 in response to controlled oil pressure pulses delivered to the actuators. Simple examples of suitable actuators include hydraulic plungers reciprocable in sleeve bushings and hydraulic rocker arms pivotable against the valve stems.

As shown in FIG. 3, the high pressure oil pump 82 is shown to be driven by a timing chain 92 from the crankshaft 24. The pump may contain a distributor, not shown, for connecting the pump 82 through hydraulic lines 94 with the various actuators 90 in timed relation in order to control timing of the various valves. Alternatively, a common rail system, not shown, could be utilized wherein the pump output is continuously connected with electrically operated valves in the actuators to control timing of the valves from an electronic engine controller. Any other suitable actuating and control arrangement could also be utilized.

Hydraulic oil that is discharged from the actuators upon closing of their respective valves is returned by gravity to the oil reservoir 74 in the engine block valley 76. This oil is preferably used to also lubricate the valve stems 48 and guides 50. However, the guides could be sealed and provided with prelubricated bushings to avoid the need for oil lubrication.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An internal combustion engine having a plurality of cylinders containing pistons connected with a crankshaft for transmitting power, the cylinders having closed ends, intake and exhaust ports communicating with the cylinders, valves operable to open and close the ports to air and exhaust flow to and from the cylinders, a pressure oil lubrication system including a first oil sump and a first oil pump operative to lubricate at least the cylinders, pistons and crankshaft of the engine, and the improvement comprising:

a valve actuating system including hydraulic actuators operable to actuate the valves; and a pressure oil hydraulic system separate from the lubrication system and including a separate oil sump and a separate oil pump operative to selectively supply pressure hydraulic oil to the hydraulic actuators to actuate the valves in a predetermined manner.

2. An engine as in claim 1 wherein the separate oil sump is a reservoir located below the actuators and positioned to receive oil discharged from the actuators and returned by gravity flow to the reservoir.

3. An engine as in claim 2 wherein the cylinders are contained in a cylinder block and the reservoir is contained within the cylinder block.

4. An engine as in claim 3 wherein cylinder block includes two cylinder banks arranged in a V and forming a valley between the cylinder banks, and the reservoir is contained in the valley.

5. An engine as in claim 1 wherein the separate oil pump is a high pressure oil pump operative to draw oil from the separate oil sump and supply pressurized oil to the actuators to actuate the valves.

6. An engine as in claim 5 wherein the high pressure oil pump is drivably connected to the crankshaft for driving the pump from the crankshaft.

7. An engine as in claim 5 wherein the hydraulic system further includes an oil filter and an oil cooler connected between the high pressure oil pump and the actuators.

8. An engine as in claim 1 wherein the separate oil systems allow the use of differing oil formulations in the lubrication and hydraulic systems and prevent entry of contaminants from the lubrication system into the hydraulic system.

* * * * *